United States Patent [19]

Bartlow

[11] Patent Number: 4,627,133

[45] Date of Patent: Dec. 9, 1986

[54] PULTRUDED UNDERGROUND TANK HOLD-DOWN STRAP ASSEMBLY

[75] Inventor: David H. Bartlow, Conroe, Tex.

[73] Assignee: Owens-Corning Fiberglas Corporation, Toledo, Ohio

[21] Appl. No.: 763,723

[22] Filed: Aug. 8, 1985

[51] Int. Cl.[4] ..... B65D 63/02; A44B 21/00

[52] U.S. Cl. ..... 24/298; 24/68 R; 24/19; 248/499; 403/224

[58] Field of Search ..... 24/298, 338, 339, 343, 24/16 PB, 68 CD, 68 R, 19; 248/499; 410/97; 403/203, 224; 405/258

[56] References Cited

U.S. PATENT DOCUMENTS

| | | | |
|---|---|---|---|
| 1,327,223 | 1/1920 | Boyle | 410/97 |
| 2,376,336 | 5/1945 | Brown | 248/499 |
| 2,519,687 | 8/1950 | Miller | 24/298 |
| 3,342,041 | 9/1967 | Nebiker, Jr. | 403/224 |
| 3,612,107 | 10/1971 | Grise | 24/19 |
| 3,668,740 | 6/1972 | Pearson | 24/16 PB |
| 3,825,227 | 7/1974 | Whitehill et al. | 24/68 R |
| 3,972,170 | 8/1976 | Brammer | 248/499 |
| 4,040,602 | 8/1977 | Foster, Sr. | 24/68 CD |
| 4,112,988 | 9/1978 | Nelson | 24/16 PB |
| 4,273,476 | 6/1981 | Kotulla et al. | 405/258 |
| 4,464,089 | 8/1984 | Allen | 410/97 |

*Primary Examiner*—Victor N. Sakran

*Attorney, Agent, or Firm*—Ronald C. Hudgens; Patrick P. Pacella; Paul J. Rose

[57] ABSTRACT

The assembly includes a pultruded glass fiber reinforced resin strap each end of which is secured between a pair of plates. At each end the plates and the strap are apertured to receive a retaining rod.

4 Claims, 5 Drawing Figures

PULTRUDED UNDERGROUND TANK HOLD-DOWN STRAP ASSEMBLY

TECHNICAL FIELD

This invention relates generally to underground tanks, and more particularly to hold-down straps for holding down underground tanks, particularly under conditions of a high water table and an empty or only partially full tank.

BACKGROUND ART

A filament-wound tank hold-down strap is disclosed in U.S. Pat. No. 3,668,740. Apparatus for forming elongated articles from fiber reinforced plastic materials by pultrusion is disclosed in U.S. Pat. No. 3,448,489.

DISCLOSURE OF INVENTION

In accordance with the invention, a pultruded tank hold-down strap is provided at each of a pair of opposite end portions with a pair of rectangular flat plates disposed respectively on opposite sides of the strap and fastened to each other with the respective end portion of the strap secured therebetween. At each end of the strap, the plates and strap are provided centrally of the plates with apertures for receiving a generally horizontal leg portion of a generally L-shaped retainer having its vertical leg portion anchored in concrete.

BRIEF DESCRIPTION OF THE DRAWINGS

The invention is more fully described hereinafter with reference to the accompanying drawings in which.

BEST MODE OF CARRYING OUT THE INVENTION

Figure 1:
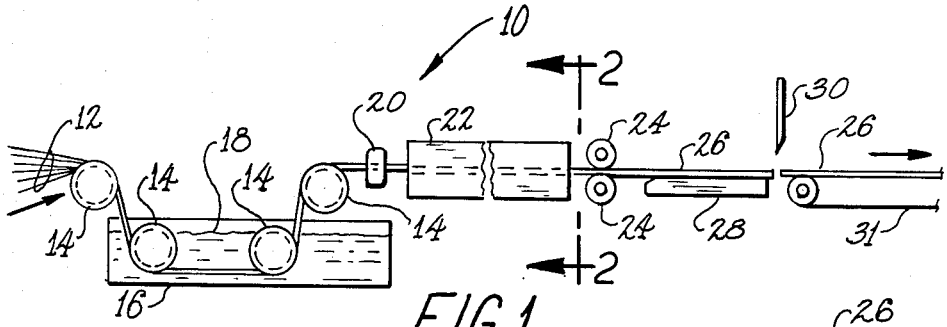
FIG. 1 is a schematic elevational view of apparatus for making pultruded straps forming part of the invention.

With reference to the drawings, FIG. 1 schematically shows apparatus 10 for making pultruded straps forming part of the invention. The pultrusion process is similar in meaning to extrusion, except that instead of the product's being pushed from an upstream location, it is pulled at a downstream location. The apparatus 10 includes supply spools, reels, or packages (not shown) for supplying glass fiber reinforcing material 12 to a series of rolls 14 which guide the material 12 through a reservoir 16 containing hardenable liquid resin 18. Excess resin 18 is stripped off the resin-impregnated material 12 by a stripper 20, and the remaining resin thereon is cured as the material 12 and resin pass through a heated curing and shaping die 22 under the influence of a pair of pulling rolls 24 acting on previously cured strap material 26. The strap material 26 is fed to a table

28, chopped to length by a reciprocable blade 30, and conveyed away by an endless belt conveyor 31.

The glass fiber reinforcing material 12 may be rovings, continuous strand mat, chopped strand mat, woven fabric, or any other suitable form.

Figure 2:
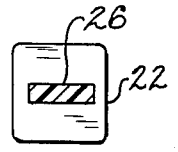
FIG. 2 is a cross-sectional view taken generally along the line 2—2 of FIG. 1.

FIG. 2. shows the strap material 26 as it emerges from the die 22.

Figure 3:
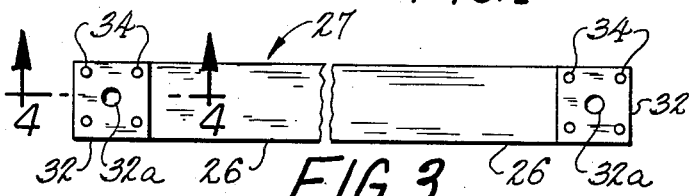
FIG. 3 is a fragmentary side view representing a tank hold-down strap constructed in accordance with the invention.
Figure 4:
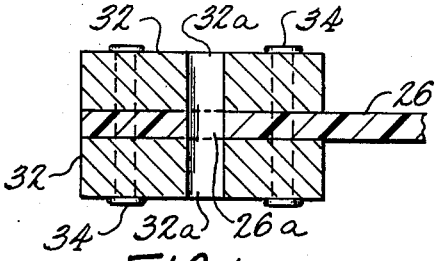
FIG. 4 is a fragmentary sectional view taken generally along the line 4—4 of FIG. 3.

FIG. 3 fragmentarily shows a pultruded underground tank hold-down strap assembly 27 constructed in accordance with the invention and including a pultruded glass fiber reinforced strap 26 having a pair of rectangular plates 32 secured to each of a pair of opposite end portions thereof respectively on opposite sides thereof by a plurality of rivets 34, as more clearly shown in FIG. 4. Each plate 32 has a central aperture **32*a* and each end of the strap 26 has an aperture 26*a* aligned with the apertures 32*a* in the respective plates 32**.

Figure 5:
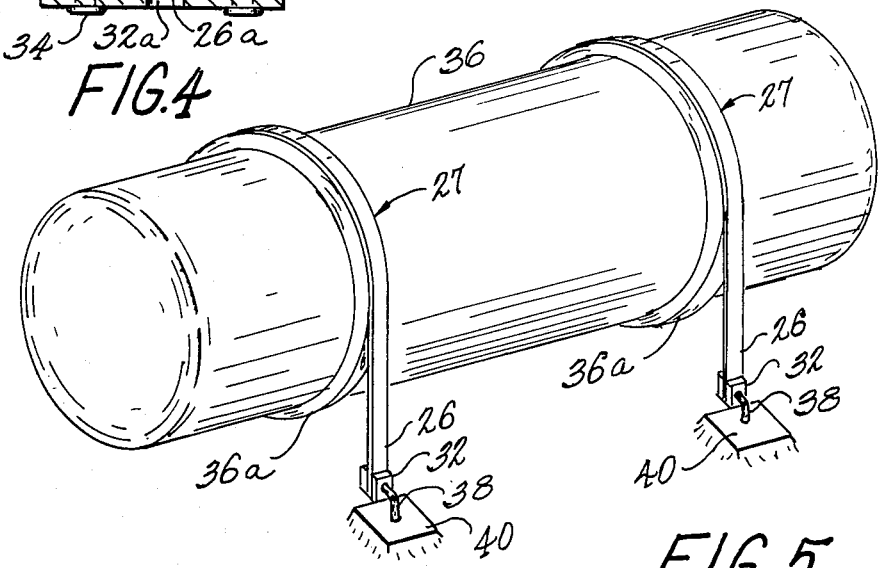
FIG. 5 is an isometric view illustrating a tank anchored by two tank hold-down straps constructed in accordance with the invention.

FIG. 5 shows an underground tank 36 held down by a pair of the strap assemblies 27 installed over external ribs **36*a* of the tank. The strap assemblies 27 are secured at each end by a generally L-shaped retaining rod 38 having a generally horizontally extending leg portion projecting through the respective apertures 32*a* and 26*a* and a generally vertical leg portion anchored in a concrete pad 40. It is understood that the tank 36** is installed below ground level.

By way of example, a strap 26 may be about one-eighth of an inch thick, about four inches wide, and about fourteen feet long when used with tanks eight feet in diameter. The plates 32 may be four inches square and about one-fourth to one-half of an inch thick, and may be made of metal or plastic. The apertures **26*a* and 32*a*** may be three-fourths of an inch in diameter.

Various modifications may be made in the structure shown and described without departing from the spirit and scope of the invention.

I claim:

1. A pultruded strap assembly for holding down underground tanks, said assembly comprising a flat glass fiber reinforced resin strap particularly characterized in that it is formed by the pulling of glass fiber reinforcing material through hardenable liquid resin and thereafter through a heated curing and shaping die, each of a pair of opposite end portions of the strap being secured flatwise between a pair of flat plates disposed respectively on opposite sides thereof and connected to each other solely by fasteners extending through the strap, each plate having an aperture extending therethrough, and each end portion of the strap having an aperture extending therethrough and aligned with the apertures of the respective pair of plates, whereby each pair of plates and the respective end portion of the strap are adapted to receive a portion of a retaining rod extending perpendicularly thereto through said apertures.

2. A pultruded strap assembly as claimed in claim 1 wherein the plates are secured together by a plurality of rivets.

3. A pultruded strap assembly as claimed in claim 1 wherein the plates are rectangular.

4. A pultruded strap assembly as claimed in claim 1 wherein the plates are square, a side length of the square being substantially equal to the width of the pultruded strap.

* * * * *